United States Patent [19]

Pickton

[11] 4,145,649

[45] Mar. 20, 1979

[54] AMPLITUDE INSENSITIVE VOLTAGE-TO-CURRENT CONVERTER AND METHOD FOR CONVERSION

[75] Inventor: Shailer T. Pickton, Lafayette, Calif.

[73] Assignee: Systron-Donner Corporation, Concord, Calif.

[21] Appl. No.: 853,264

[22] Filed: Nov. 21, 1977

Related U.S. Application Data

[63] Continuation of Ser. No. 659,213, Feb. 19, 1976, abandoned.

[51] Int. Cl.[2] ..... G05F 1/56

[52] U.S. Cl. ..... 323/4; 307/61; 307/264; 323/25

[58] Field of Search ..... 323/4, 8, 9, 17, 22 T, 323/22 SC, 23, 25; 307/264, 270, 127, 60, 61; 363/97

[56] References Cited

U.S. PATENT DOCUMENTS

| | | | |
|---|---|---|---|
| 3,518,457 | 6/1970 | Herrmann et al. | 307/61 |
| 3,704,381 | 11/1972 | Nercessian | 307/60 |
| 3,742,330 | 6/1973 | Hodges et al. | 323/4 |
| 3,870,896 | 3/1975 | Kiko | 323/4 |

OTHER PUBLICATIONS

*IBM Tech Disc Bull* vol. 10, No. 7 Dec. 1967 pp. 1045–1046 "Current Supply" by R. E. May, Jr.

*Primary Examiner*—Gerald Goldberg

*Attorney, Agent, or Firm*—Flehr, Hohbach, Test, Albritton & Herbert

[57] ABSTRACT

A current source is formed utilizing a reference voltage which is impressed on an impedance connected to the input of an operational amplifier. A buffer amplifier is coupled between the output and the input of the operational amplifier to prevent interaction between a high impedance signal source and a low impedance load. A constant output current appears at the output of the buffer amplifier, connected to a first electronic switch. A second electronic switch is connected to the other side of the load. A pair of signals having unstable amplitude are connected to control the first and second electronic switches. When the second electronic switch is either continuously on or alternatively on and off with the first electronic switch, the constant current is directed through the load when the first electronic switch is actuated to the off or open position, and is directed by bypass the load, when the first electronic switch is actuated to the on or closed condition.

22 Claims, 8 Drawing Figures

AMPLITUDE INSENSITIVE VOLTAGE-TO-CURRENT CONVERTER AND METHOD FOR CONVERSION

This is a continuation, of application Ser. No. 659,213 filed Feb. 19, 1976, now abandoned.

BACKGROUND OF THE INVENTION

This invention relates to a unipolar or bipolar amplitude fluctuating voltage signal to constant current signal converter, and more particular to such a converter for providing stable performance in conjunction with current operated devices.

A force balance device in which a current sensitive rebalance component is utilized to close the servo loop is subject to the power transferring inefficiencies inherent in the coupling of a high impedance signal source with a low impedance current sensitive device as well as to the response characteristics of an analog circuit. There is a need therefore for means by which a force rebalance mechanism can be operated utilizing constant current pulses commanded by signal source voltage levels of fluctuating amplitude.

SUMMARY AND OBJECTS OF THE INVENTION

In general, a circuit is disclosed for conversion of an unstable voltage level signal to a stable current level signal which includes circuit means for providing a reference voltage level signal. An operational amplifier having input and output terminals has an impedance coupled to the input with the reference voltage level impressed thereacross. A buffer amplifier is coupled between the input and the output of the operational amplifier and provides a current output scaled by the impedance on the operational amplifier input for a given reference voltage level. A switch is coupled to receive the current output. The switch is actuated by the unstable voltage level signal for passing constant current output pulses having a time duration substantially the same as the time duration of the unstable voltage level signal.

In general it is an object of the present invention to provide electronic circuitry which provides a precise constant current pulse in response to an unregulated voltage level command pulse.

It is another object of the present invention to provide electronic circuitry which directs a precision constant current to a current sensitive device in response to a fluctuating voltage level signal.

It is another object of the present invention to provide electronic circuitry for use with a current sensitive device to obtain uniform current pulses insensitive to the amplitude of actuating signal pulses for use in a digital pulse rebalance system.

It is another object of the present invention to provide electronic circuitry for use with a current sensitive device which provides uniform amplitude current pulses in response to nonuniform amplitude signal pulses having a dwell time and polarity substantially the same as the voltage pulses.

Additional objects and features of the invention will appear from the following description in which the preferred embodiment has been set forth in detail in conjunction with the accompanying drawings.

DESCRIPTION OF THE PREFERRED EMBODIMENTS

Figure 1:
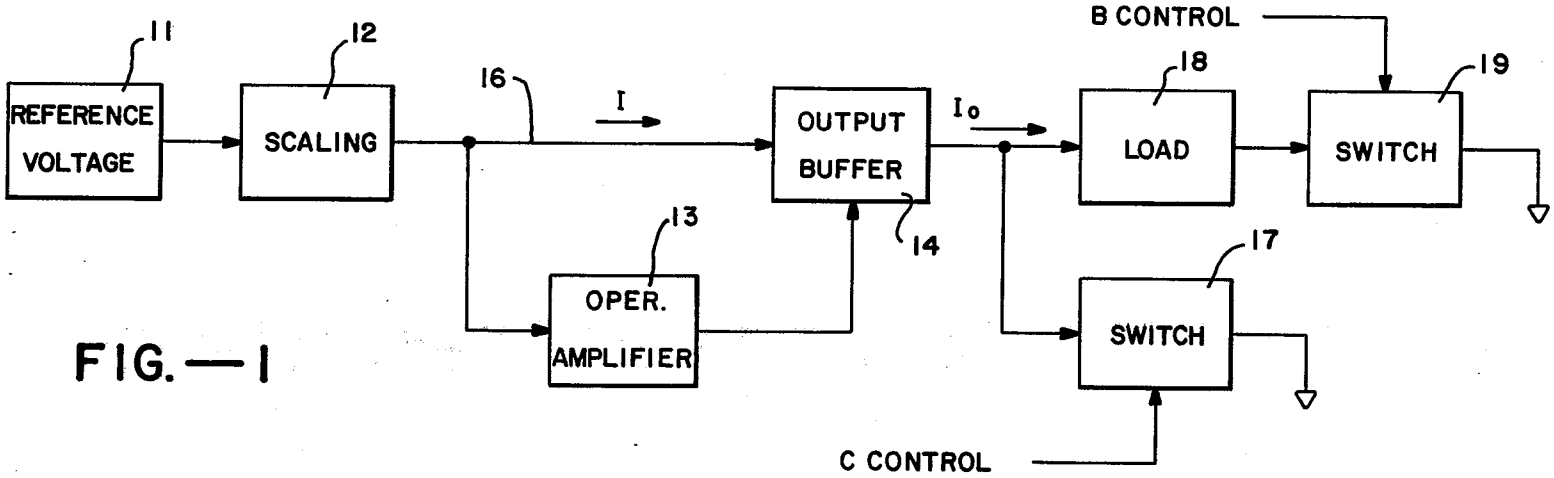
FIG. 1 is a block diagram of one embodiment of the disclosed invention.

Referring to FIG. 1 of the drawings, one embodiment of the invention is seen in block form. Means 11 for providing a reference voltage is coupled to a scaling component 12 so that the magnitude of the current I is determined. Scaling component 12 is coupled to the input of an operational amplifier 13 having an output buffer 14 coupled between the output and the input of the operational amplifier 13. A feedback path 16 around operational amplifier 13 includes output buffer 14. Current I flows through feedback path 16. Output buffer 14 produces a current output $I_0$ which is coupled to a first switch 17 and one terminal of an electric load 18. A second switch 19 is provided which is connected to the opposite terminal of electric load 18. First and second switches 17 and 19 are configured to pass current $I_0$ when actuated. Actuation control signals are connected to switches 17 and 19 at terminals marked C control and B control respectively.

Figure 2:
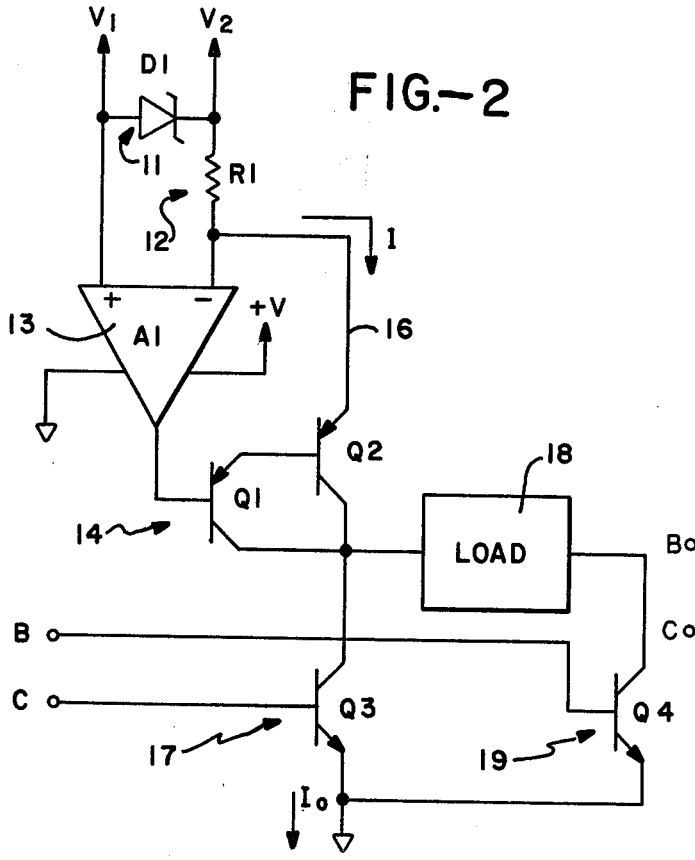
FIG. 2 is an electrical schematic of the embodiment of FIG. 1.

The block diagram of FIG. 1 may be seen in schematic form in FIG. 2. Zener diode $D_1$ provides means for producing a reference voltage, which is $V_2-V_1$ from FIG. 2. The reference voltage $V_2-V_1$ is impressed across an impedance $R_1$, representing means for scaling 12, which is coupled to the input of operational amplifier 13, signified by component $A_1$ in FIG. 2. Buffer amplifier 14 is present in the form of the Darlington transistor pair $Q_1$ and $Q_2$ coupled between the output and the input of operational amplifier $A_1$. Buffer amplifier 14 produces an output current $I_0$ which is directed through the circuit path containing switch 17, depicted by electronic switch $Q_3$, or the path containing load 18 and switch 19, depicted by the electronic switch $Q_4$. The path taken by current $I_0$ is dependent upon voltage control signals presented at terminals B and C which are the B control and C control signals indicated in FIG. 1.

The manner in which the embodiment of FIGS. 1 and 2 operates will now be described. As is known to those skilled in this field of art the characteristics of an operational amplifier include the following: the two input terminals on operational amplifier 13 are always at the same voltage level; there exists a virtual short circuit at the input of operational amplifier 13. The term "virtual" is used to imply that while the voltage between the input terminals is kept at zero, no current actually flows between the input terminals. Furthermore, there is no current flow into or out of either input terminal. The output of the operational amplifier 13 changes to cause the current I in feedback path 16 to assume a value such that the zero voltage difference between input terminals and zero current flow into or out of either input terminal always exists. The Darlington circuit represented by the connection of transistors $Q_1$ and $Q_2$ forming a buffer amplifier 14 presents a low input impedance and a high output impedance for preventing interaction between the low impedance load circuit 18 and the relatively high impedance source supplying the potential which is regulated to the value $V_2-V_1$. The feedback current I is the emitter current in transistor $Q_2$, which is substantially the same as the collector current $I_0$ of transistor $Q_2$, which is the output current from buffer amplifier 14. The amplitude of the output current $I_0$ is constant and is determined by the reference voltage $V_2-V_1$ and the impedance $R_1$ across which the reference voltage is impressed.

Voltage signals presented at terminals B and C having unstable amplitude characteristics will actuate transistor switches $Q_4$ and $Q_3$ respectively for the dwell time of the voltage level signals at the respective terminals B and C. Constant amplitude output current $I_0$ is seen to transit transistor switch $Q_3$ when a voltage level signal sufficient to turn transistor $Q_3$ "on" is presented to terminal C, for the dwell time of the voltage level signal and independent of the voltage level fluctuations therein. During this dwell time essentially no current will transit load 18 whether transistor switch $Q_4$ is on or off. Transistor switch $Q_4$ may therefore be replaced by a conductor, or permanently turned on by an appropriate voltage level signal at terminal B, or alternately turned on and off by inputs to terminal B which are complimentary in time to the inputs to terminal C. When transistor switch $Q_3$ is in the unactuated or off condition by virtue of an absence of actuating signal at terminal C, and transistor $Q_4$ is in an "on" condition by virtue of an actuating signal at terminal B, the same constant current $I_0$ transits load 18 and transistor switch $Q_4$.

Figure 3:
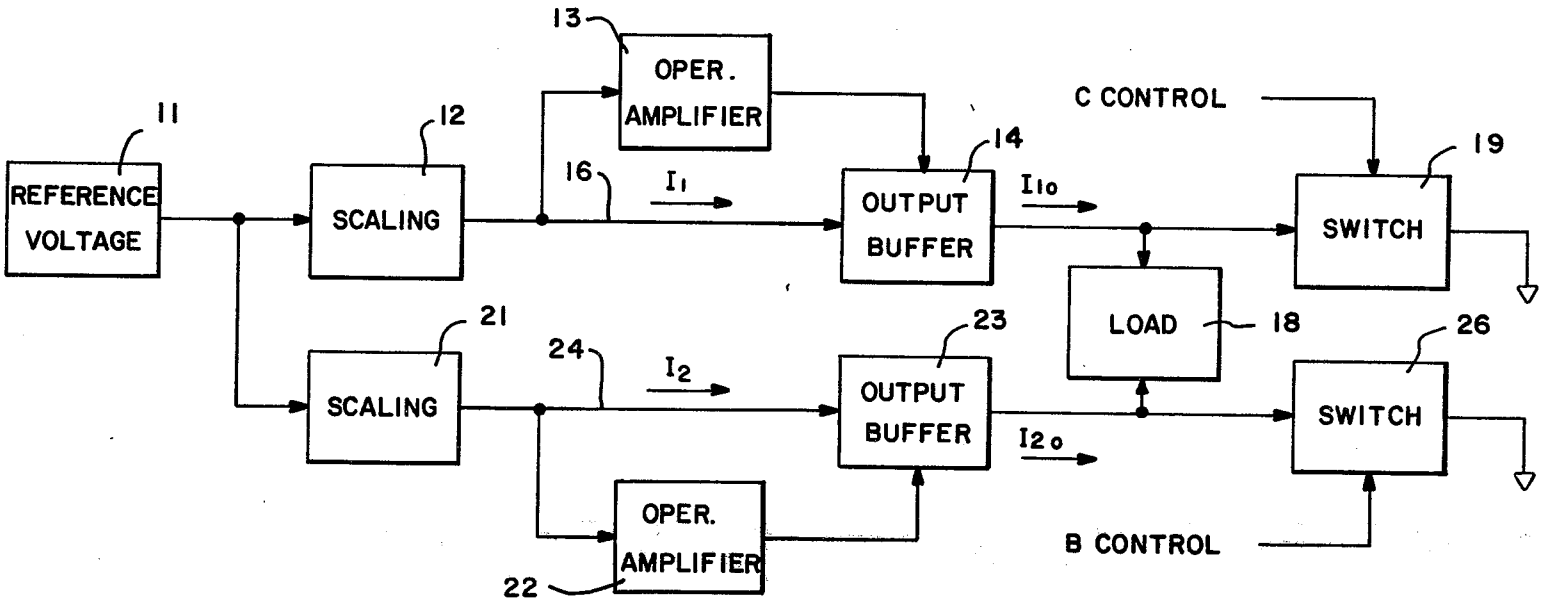
FIG. 3 is a block diagram of another embodiment of the disclosed invention.

Another embodiment of the present invention is seen in block form in FIG. 3. Like components common to the block diagram of FIG. 1 will be given like item numbers. Means 11 is present for providing a reference voltage level signal which is coupled to each of two parallel paths. The first parallel path includes means 12 for scaling the output current which is connected to the input of an operational amplifier 13. An output buffer 14 is connected between the output and the input of operational amplifier 13 and a feedback path 16 for passing a current $I_1$ includes an output buffer 14. A current output $I_{10}$ is provided at the output of output buffer 14 which is coupled to one terminal of load 18 and to switch 17, which is operated by a fluctuating voltage level signal indicated as C control.

The second parallel path in FIG. 3 includes additional means 21 for scaling an additional constant current output, and an additional operational amplifier 22 having the additional means 21 coupled to the input thereof. An additional output buffer 23 is coupled between the output and the input of operational amplifier 22 and is included in a feedback path 24 around operational amplifier 22. An additional constant current output $I_{20}$ is provided at the output of output buffer 23 and is connected to the opposite terminal of load 18 and to one side of an additional switch 26. Additional switch 26 is controlled by a fluctuating amplitude voltage level signal injected as B control in FIG. 3.

Figure 4A:
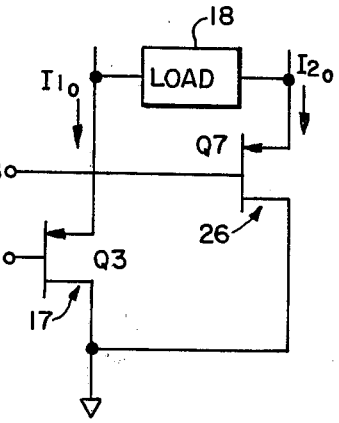
FIG. 4*a* is a partial electrical schematic of another embodiment of FIG. 3.
Figure 4:
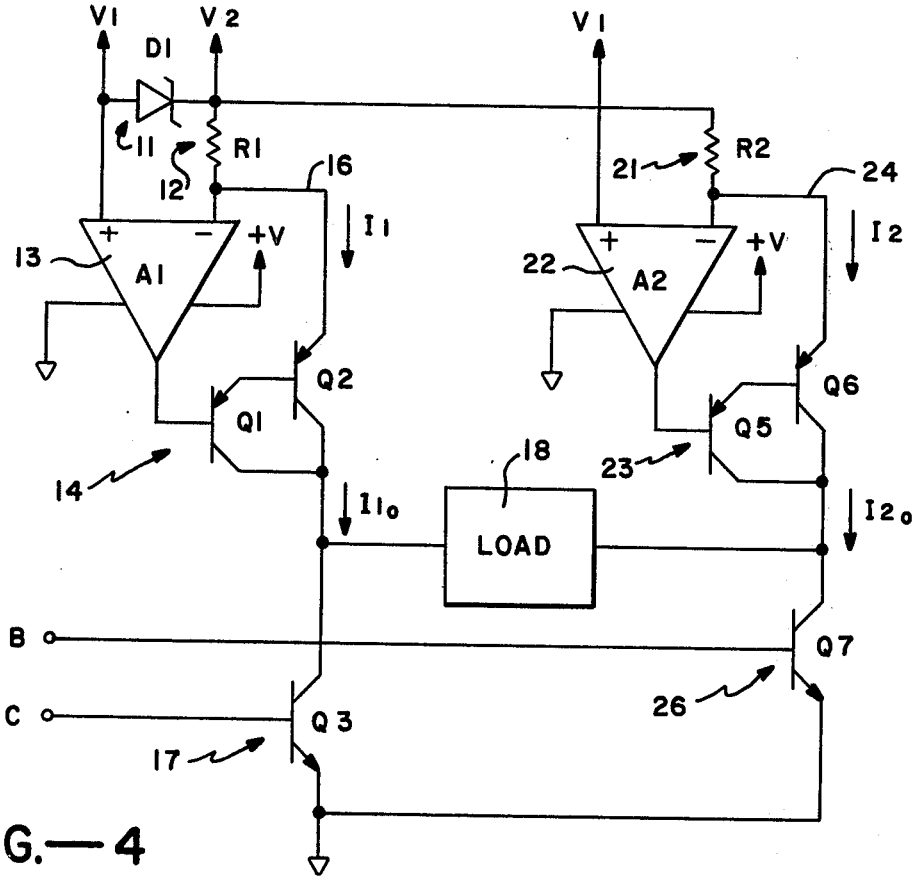
FIG. 4 is an electrical schematic of the embodiment of FIG. 3.

The circuit schematic for the block diagram of FIG. 3 is seen in FIG. 4. The circuit for generating constant current $I_{10}$ is the same as that described for generating the constant current $I_0$ in FIG. 2 above. The output of buffer amplifier 14, constant current $I_{10}$, is coupled to one terminal of load 18 and to one side of transistor switch $Q_3$. Transistor switch $Q_3$ is shown having a base control terminal C for receiving an actuating voltage level signal having an unstable amplitude. The circuit for providing constant current $I_{20}$ is the same as that described before for generating constant current $I_0$ in FIG. 2, wherein reference voltage $V_2-V_1$ is impressed across an impedance $R_2$ representing additional means 21 for scaling the constant current $I_{20}$. Impedance $R_2$ is coupled to the input of operational amplifier $A_2$ representing block 22 in FIG. 3. The Darlington transistor pair $Q_5$ and $Q_6$ represents the output buffer 23 and provides an output current $I_{20}$ which has a constant amplitude determined by the reference voltage $V_2-V_1$ and the impedance $R_2$.

As described above the emitter current $I_2$ for transistor $Q_6$ is substantially the same as the constant output current $I_{20}$ from output buffer 23. The output current $I_{20}$ is coupled to the other terminal of load 18 and to transistor switch $Q_7$ representing switch 26 of FIG. 3. Transistor $Q_7$ has a terminal B to which is applied actuating voltage level signals having unstable amplitude characteristics. The manner in which the embodiment of FIG. 4 operates is described as follows. The generation of constant output currents $I_{10}$ and $I_{20}$ is the same as that described for the generation of constant current output $I_0$ in FIG. 2 above. Amplitude fluctuating voltage level signals are alternately applied at terminals B and C of FIG. 4, thereby alternately directing constant current levels $I_{10}$ and $I_{20}$ through load 18 respectively. Current $I_{10}$ will transit load 18 for the dwell time of the amplitude unstable voltage level applied to terminal B. No current flows through transistor switch $Q_3$ as there is no signal at terminal C and a current through transistor switch $Q_7$ is the sum of the currents $I_{10}$ and $I_{20}$. Upon removal of the unstable voltage level signal from terminal B and replacement of such a signal on terminal C, transistor switch $Q_7$ is opened, no current flows therethrough, and current $I_{20}$ flows in a direction opposite to that of current $I_{10}$ through load 18 for the dwell time of the voltage level signal on terminal C. Transistor switch $Q_3$, being in the conducting condition, passes the sum current $I_{10}$ and $I_{20}$. In this fashion, constant current having alternate polarity is passed through load 18.

Figure 5:
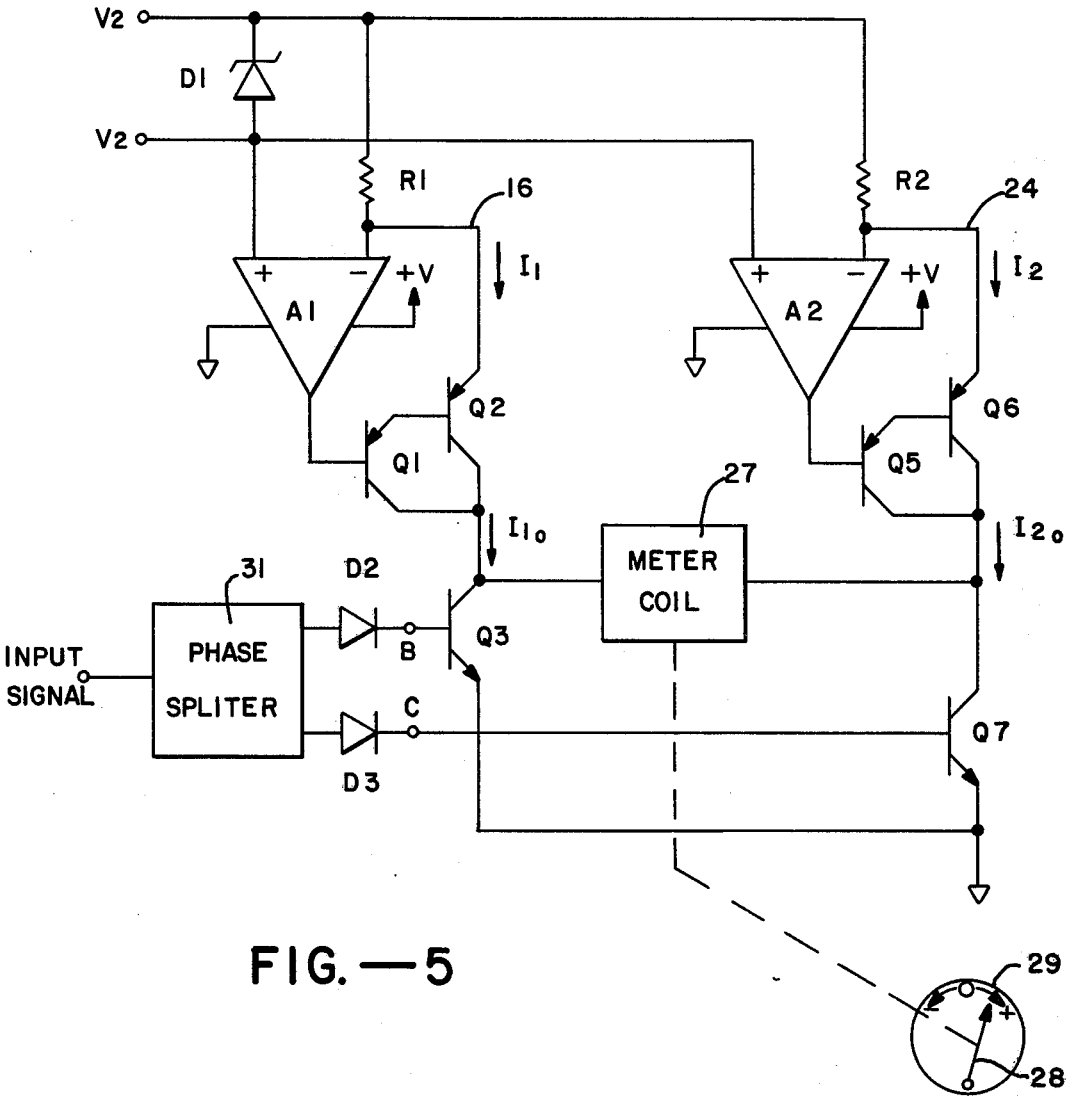
FIG. 5 is an electrical schematic of one useful form of the disclosed invention.

Turning now to FIG. 5, one use of the disclosed invention is shown. FIG. 5 is similar to FIG. 4 in many respects, and like items have like item numbers and designations. The circuit structure and manner in which constant output currents $I_{10}$ and $I_{20}$ are obtained is described above. The electrical load is a meter coil 27 in this embodiment. Meter coil 27 is a current actuated device providing for angular displacement of the coil as a function of current therethrough when rotationally suspended in a magnetic field. Meter coil 27 is mechanically coupled to an indicator needle 28 for motion over a dial face 29.

Figure 6:
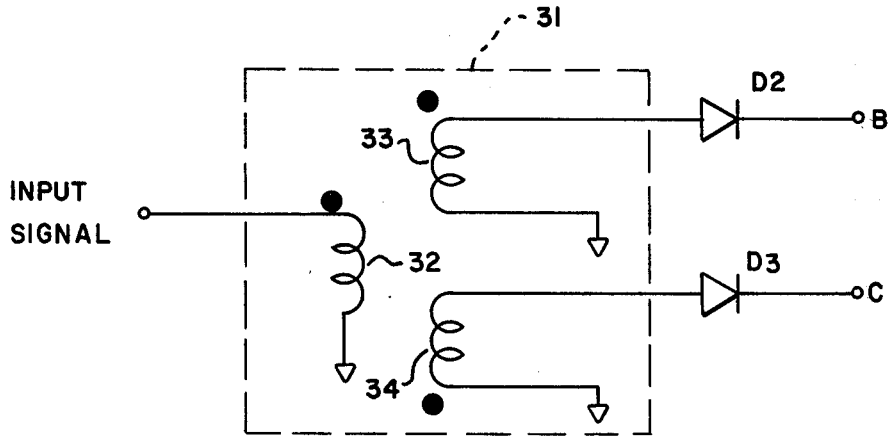
FIG. 6 is an electrical schematic of a phase splitter for use in the disclosed invention.
Figure 7:
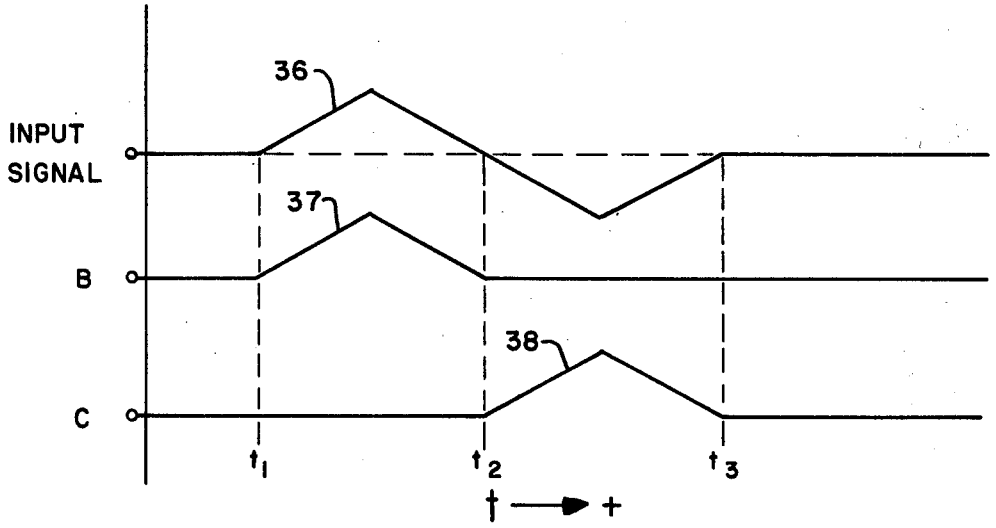
FIG. 7 is a timing diagram showing the input and output signals in the circuit of FIG. 6.

A phase splitter 31 is shown receiving an input signal and providing two outputs through diodes D2 and D3 to terminals B and C respectively. Reference is made to FIG. 6 for the structural details of phase splitter 31 and to FIG. 7 for a timing diagram showing the time relationships between the input signal and the output signals coupled to terminals B and C. In this configuration the input signal is connected to the primary winding 32 on a transformer having the polarity indicated. A pair of secondary windings 33 and 34, having polarity indicated in FIG. 6, are coupled to terminals B and C through diodes D2 and D3 respectively. The input/output signal relationships seen in FIG. 7 result. An alternating input signal having the arbitrary amplitude envelope seen at 36 induces an in phase signal in the secondary winding 33 having the amplitude envelope 37 which is presented at terminal B. Output 37 at terminal B may be seen to have a dwell time which is substantially t2−t1. An amplitude envelope 38 is seen for the AC signal induced in secondary winding 34 and presented through diode D3 to terminal C. The dwell time of the fluctuating voltage level signal at terminal C is seen to be t3−t2, and the signal is out of phase with the input signal. In this fashion, reversing polarity control or drive signals are presented to the actuating terminals for the transistor switches $Q_3$ and $Q_7$ as like polarity signals for reversing the direction of the constant current through the meter coil 27 in accordance with the polarity of the control signal. Constant current levels are therefore directed to meter coil 27 in accordance with the polarity of the input voltage level signal and without regard for the amplitude fluctuations in the input voltage level signal.

It should be noted that transistor switches $Q_3$ and $Q_7$ could be replaced by any other type of suitable switch, such as field effect transistors with gates connected to terminals B and C. Any device displaying nearly a short circuit in the presence of a control signal and nearly an open circuit in the absence of a control signal would be a suitable switch FIG. 4*a* shows a partial schematic similar to that of FIG. 4 which is suitable. It is understood that field effect devices are also usable in the embodiment of FIG. 2 in place of bipolar transistors Q3 and Q4 shown.

Since the amplitude of the constant current outputs $I_{10}$ and $I_{20}$ are determined by the magnitudes of the impedances R1 and R2, the constant current outputs may be scaled by adjustment of the R1 and R2 magnitudes. Thus, the scaling of the deflection of needle 28 on dial face 29 may be adjusted. Moreover, a current sensitive component such as meter coil 27, may exhibit a bias. The bias referred to is defined as a characteristic whereby the meter coil deflects through a greater angle for one polarity of current compared to the opposite polarity of current having the same magnitude or that produced by a mechanical spring set off zero. In such an event the impedances R1 and R2 may be adjusted singly to remove the bias in the current sensitive component.

Figure 8:
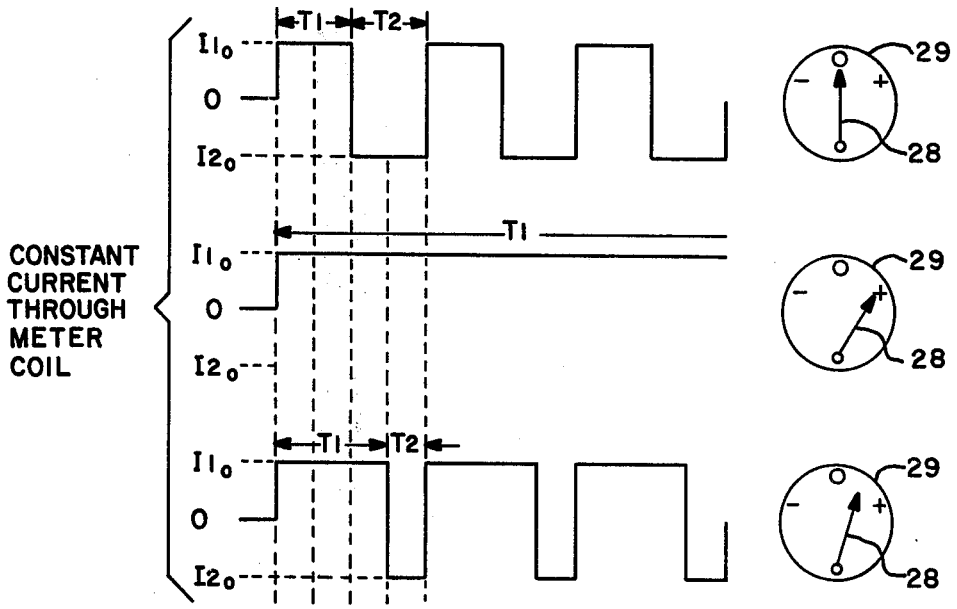
FIG. 8 is a timing diagram showing various meter coil current pulse waveforms for the embodiment of FIG. 5.

FIG. 8 shows the manner in which the apparatus of FIG. 5 displays an indication on dial face 29. Since the fluctuating voltage level signals at B and C are time coincident with the constant currents $I_{20}$ and $I_{10}$ respectively through metered coil 27, the timing diagram of FIG. 8 is expressed in terms of the constant currents. In the upper diagram of FIG. 8, equal time duration signals are presented to terminals B and C of FIG. 5 providing for alternating pulses of $I_{20}$ and $I_{10}$ respectively through meter coil 27 of equal dwell periods, $T_1$ and $T_2$. As indicated to the right of the upper diagram, indicator needle 28 will indicate a zero reading on dial face 29. In the middle of diagram of FIG. 8 an unstable voltage level signal is presented to terminal C of FIG. 5 continuously. Consequently, as indicated to the right of the middle diagram indicator needle 28 is deflected full scale on dial face 29. In the lower diagram of FIG. 8 an actuating voltage level signal is presented at terminal C in FIG. 5 for the period $T_1$ and the terminal B for the period $T_2$. Since transistor switch $Q_7$ directs constant current $I_{10}$ through meter coil 27 for three quarters of the time total of periods $T_1$ and $T_2$, indicator needle 28 will take a position halfway between zero and the positive extreme seen on dial face 29, or three quarters of the full deflection of needle 28.

The device disclosed herein is particularly useful for current pulse rebalance applications where a digital input is available to terminals B and C. The invention disclosed herein may be used in a unipolar configuration such as that disclosed in conjunction with FIG. 2 or in a bipolar configuration such as that disclosed in conjunction with FIG. 4. Conversion of voltage pulses to time coicident constant current pulses is obtained, wherein the current pulses are insensitive to voltage pulse amplitude fluctuation. Wide voltage amplitude swings can be applied at the load terminals without load current amplitude change.

What is claimed is:

1. A dual current source responsive to alternate first and second control signals for providing current to an electrical load comprising first and second operational amplifiers each having an input and an output, means for providing a voltage reference coupled to each of said inputs, first and second buffer amplifiers coupled between said input and output of each of said first and second operational amplifiers for buffering therebetween and providing respective first and second current output therefrom having the same polarity and connected to opposite side of the electrical load, first and second electronic switches actuated by the first and second control signals respectively connected to opposite sides of said load and operating to pass said first and second current outputs when actuated, first and second means for setting the magnitudes of said first and second current outputs respectively to maintain constant predetermined levels, whereby said predetermined first and second current levels are switched through the electrical load alternately in response to application of the second first control signals respectively.

2. A dual current source as in claim 1 wherein said first and second means for setting the magnitudes of said first and second current outputs comprise first and second resistors connected between the inputs of said first and second operational amplifiers respectively and said means for providing a voltage reference.

3. A dual current source as in claim 2 wherein said electrical load is current operated and said first resistor is larger then said second resistor to adjust for bias in the operation of the electrical load.

4. A dual current source as in claim 2 wherein said electrical load is current operated, and means for equal adjustment of the magnitude of said first and second resistors to adjust for scale factor in the operation of the electrical load.

5. In a dual current source for directing constant currents in alternate directions through an electrical component between terminals thereon, and utilizing voltage levels as control signals, a pair of operational amplifiers, and impedance connected to the input of each of said pair of operational amplifiers, means for providing a reference voltage connected to each of said impedances, means for buffering coupled to each of said pair of operational amplifiers between the input and output thereof, said last named means each providing a constant current output connected to one of the terminals on the electrical component, and means for switching said constant currents to alternately bypass and transit the electrical component, said means for switching being responsive to the voltage level signals.

6. A dual current source as in claim 5 together with a phase splitter for receiving the voltage levels and providing first and second outputs providing in phase and out of phase drive signals respectively, wherein said means for switching comprises first and second electronic switches having actuating terminals for receiving said first and second phase splitter outputs respectively.

7. A method for obtaining a pulse width modulated constant current level for connection to an electrical circuit utilizing a fluctuating voltage signal, comprising the steps of connecting an impedance to one input of an operational amplifier, applying a reference voltage across the impedance, buffering the output of the operational amplifier from the input, connecting the buffered output to the electrical circuit and to an electronic switch, and actuating the electronic switch selectively with the fluctuating voltage to thereby direct the constant current alternately to bypass the electrical circuit through the switch and to transit the electrical circuit.

8. A method for obtaining a dual constant current for alternate direction through an electrical circuit responsive to a fluctuating control signal of changing polarity, comprising the steps of connecting a reference current to an impedance at one input of an operational amplifier, connecting a reference current to an impedance on one input of another operational amplifer, buffering the input from the output on each operational amplifier, connecting the buffered outputs to a pair of electronic switches, actuating each one of the pair of electronic switches alternately with one polarity of the fluctuating control signal, thereby directing the buffered outputs to alternately bypass the electrical circuit through one of the switches and to transit the electrical circuit through the other.

9. An electronic circuit for directing current having a predetermined, constant amplitude through a load in response to the presence of a given signal, said load having first and second terminals, said circuit comprising:

(a) means for producing at its output a current having a predetermined, constant amplitude, said output adapted for connection to said first load terminal, said means including
  (i) an operational amplifier having first and second input terminals and an output terminal,
  (ii) means coupled to said first amplifier terminal for scaling said current,
  (iii) means connected between said second amplifier terminal and said scaling means for determining a predetermined reference voltage level, said voltage level determining means and said scaling means together determining the amplitude of said current, and
  (iv) a buffer amplifier connected between the output terminal of said operational amplifier and said first amplifier terminal, said buffer amplifier including said first mentioned output;

(b) a switch having one side coupled to the output of said current producing means and the otherside being adapted for connection to the second load terminal of said load, said switch being adapted to operate between a first state in response to said given signal and a second state in the absence of said signal, said current being directed through said load from said first to said second terminal when said switch is in said second state and bypassing said load when said switch is in said first state.

10. An electronic circuit as in claim 9 wherein said switch in a transistor having a base, emitter and collector, said base being coupled to said given signal.

11. An electronic circuit as in claim 9 wherein said switch is a field effect transistor having a gate, drain and source, said gate being coupled to said given signal.

12. An electronic circuit as in claim 9 wherein said means for scaling is a resistor.

13. An electronic circuit as in claim 9 wherein said means for providing a reference voltage is a zener diode.

14. An electronic circuit as in claim 9 wherein said given signal is a voltage signal, the amplitude of which is unstable.

15. An electronic circuit as in claim 9 operating to direct a second current having a predetermined, constant amplitude to said load in response to the presence of a second given signal, said circuit including (c) second means for producing at its output a current having predetermined, constant amplitude, said last mentioned output being adapted for connection to said second load terminal, said second means including
  (i) a second operational amplifier having first and second input terminals and an output terminal
  (ii) second means coupled to said first terminal of said second amplifier for scaling said second current,
  (iii) said voltage level determining means connected between said terminal of said second amplifier and said last-mentioned scaling means, said voltage level determining means and said second scaling means together determining the amplitude of said current, and
  (iv) a second buffer amplifier connected between the output of said second operational amplifier and said first terminal of said second amplifier, said buffer amplifier including said output of said second current producing means, and (d) a second switch having one side connected to the output of said second current producing means and its other side being connected to said other side of said first-mentioned switch, said second switch being adapted to operate between a first state in response to said second given signal and a second state in response to the absence of said second signal, said second current bypassing said load when said second switch is in said first state and being directed through said load from said second load terminal to said first load terminal when said switch is in said second state.

16. A current producing circuit comprising:

(a) means for providing a reference voltage level signal;

(b) an operational amplifier having an input thereto and providing an output therefrom;

(c) a buffer amplifier coupled between said operational amplifier input and output for providing buffering therebetween and for providing a current output;

(d) a switch having one side coupled to said buffer amplifier output, said switch being operated by a given voltage signal;

(e) means for scaling said current output to assume a predetermined level, said last named means being coupled to said amplifier input and said reference voltage level signal; and (f) a current operated device having one device terminal connected to the output of said buffer amplifier and the other device terminal connected to the other side of said switch, whereby said predetermined level of current output is selectively shunted to bypass and directed to pass through said current operated device responsive to the given voltage signal.

17. A circuit as in claim 16 wherein the voltage signal has an additional component, together with an additional operational amplifier having an input and an ouput with said reference voltage level signal connected to said input, an additional buffer amplifier coupled between said additional operational amplifier input and output for providing buffering therebetween and providing an additional current output, an additional switch having one side coupled to the output of said additional buffer amplifier, the other side coupled to the other side of said switch, and being operated by the additional components of the voltage signal, additional means for scaling said additional current output to assume a predetermined level, said last named additional means being coupled to said additional operational amplifier input, said additional current output being connected to the other device terminal on said current operated device, whereby said additional switch selectively directs said additional current output to bypass and to transit said current operated device in a direction opposing said current output in response to the additional component of the voltage signal.

18. A circuit as in claim 17 wherein said means for scaling and additional means for scaling are first and second resistors respectively, whereby changes of equal magnitude in said first and second resistors adjust scale factor relative to said current operated device and changes of independent magnitude therebetween adjust bias in said current operated device.

19. An electronic circuit for selectively directing current having a predetermined, constant amplitude through an electrical load in response to a pair of given signals, said load having first and second input terminals thereon, said circuit comprising:

(a) a constant current source providing the constant current connected to the first electrical load input terminal, (b) a first electronic switch connected to the first electrical load input terminal and adapted to receive a first one of said given signals, (c) a second electronic switch connected to the second electrical load terminal and adapted to receive a second one of said given signals, (d) said first and second switches each being respectively actuated by said given signals, so that the constant current transits the electrical load during the presence of said second signal at said second electronic switch, and bypasses the electrical load during the presence of said first signal at said first electronic switch.

20. An electronic circuit as in claim 19 wherein said given signals are voltage signals.

21. An electronic circuit for directing a first current having a predetermined constant amplitude through a load, in one direction, in response to the presence of a first given signal and for directing a second current having a predetermined constant amplitude through the load, in an opposite direction, in response to the presence of a second given signal, said load including first and second load terminals, said circuit comprising:

(a) a constant current source providing the constant current connected to the first electrical load input terminal, (b) a first electronic switch connected to the first electrical load input terminal, (c) a second current source providing a second constant current connected to the second load terminal, (d) a second electronic switch connected to the second load terminal in shunt with the electrical load, (e) said first and second electronic switches being respectively and alternatively actuated by said given signals, whereby said first current transits the electrical load during the presence of the second signal at said second electronic switch, and said second current transits the electrical load in a sense opposite to said first constant current during the presence of the first signal at said first electronic switch.

22. An electronic circuit as in claim 21 wherein said given signals are voltage signals.

* * * * *